US005148085A

United States Patent [19]

Kroes

[11] Patent Number: 5,148,085

[45] Date of Patent: Sep. 15, 1992

[54] ELECTRODELESS LOW-PRESSURE DISCHARGE LAMP

[75] Inventor: Anthony Kroes, Eindhoven, Netherlands

[73] Assignee: North American Philips Corporation, New York, N.Y.

[21] Appl. No.: 649,086

[22] Filed: Jan. 31, 1991

[30] Foreign Application Priority Data

Feb. 2, 1990 [NL] Netherlands ..... 9000259

[51] Int. Cl.[5] ..... H05B 41/10; H05B 41/24

[52] U.S. Cl. ..... 315/248; 313/25; 313/27; 313/44; 313/634

[58] Field of Search ..... 313/25, 493, 634, 44, 313/492, 26, 27, 17; 315/248, 39

[56] References Cited

U.S. PATENT DOCUMENTS 2,084,772 6/1937 Marden ..... 313/27
2,177,755 10/1939 Uyterhoeven ..... 313/27
2,194,300 3/1940 Found ..... 313/27
4,805,180 2/1989 Maitland et al. ..... 313/17
4,922,157 5/1990 Van Engen et al. ..... 313/493
4,927,217 5/1990 Kroes et al. ..... 313/493

FOREIGN PATENT DOCUMENTS 0298538 1/1989 European Pat. Off. .

*Primary Examiner*—Donald J. Yusko
*Assistant Examiner*—Andrew M. Hill
*Attorney, Agent, or Firm*—Brian J. Wieghaus

[57] ABSTRACT

The electrodeless low-pressure discharge lamp comprises a tube which is closed at one end, which surrounds a body of soft magnetic material with clearance, and which is enclosed with clearance in the cavity in the outer bulb, which cavity enters the cavity in the discharge vessel. The tube provides a good insulation of the body from the heat of the discharge in the discharge vessel.

10 Claims, 1 Drawing Sheet

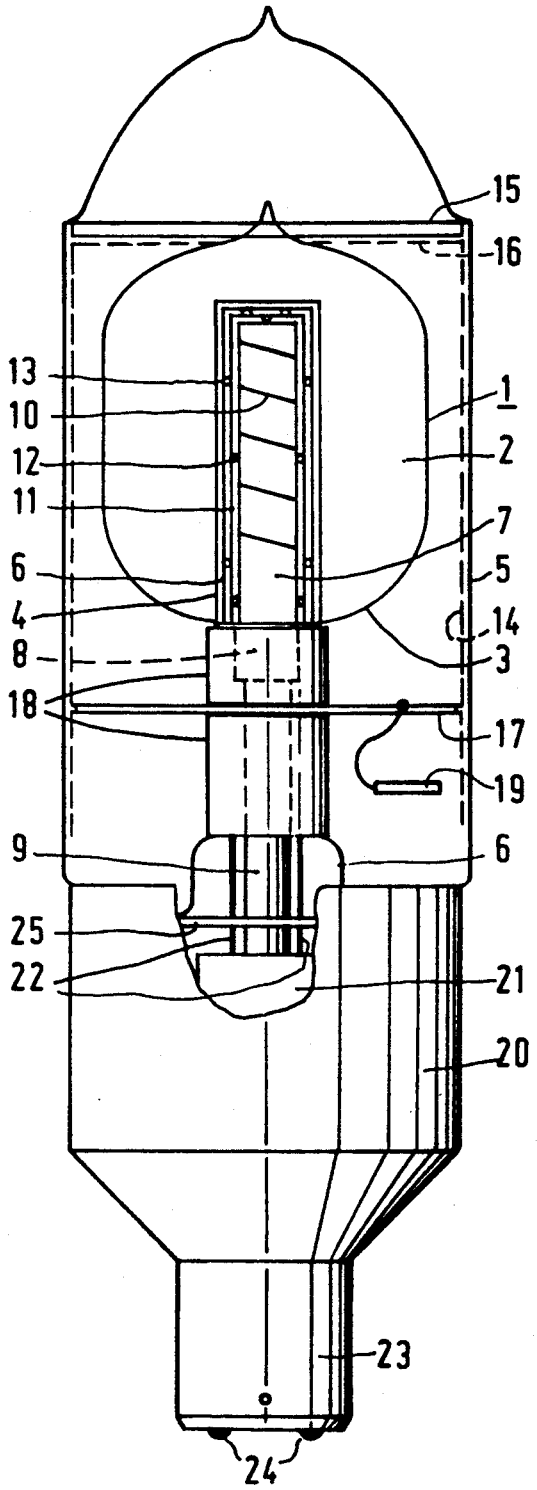
15
16
13
10
12
11
6
4
8
18
9
25
22
1
2
7
5
14
3
17
19
6
21
20
23
24

ELECTRODELESS LOW-PRESSURE DISCHARGE LAMP

BACKGROUND OF THE INVENTION

The invention relates to an electrodeless low-pressure discharge lamp comprising

- a discharge vessel with a discharge space containing an ionizable vapour and rare gas, the discharge vessel having a cavity at an end portion,
- an evacuated outer bulb surrounding the discharge vessel, which outer bulb has a cavity which enters the cavity of the discharge vessel,
- a body of soft magnetic material enclosed in the cavities, which body has an end near the end portion of the discharge vessel and is supported at said end by a thermal insulator,
- an electric coil inside the cavity of the discharge vessel around said body of soft magnetic material,
- a heat-repelling envelope of electrically insulating material between the body of soft magnetic material and the discharge space.

Such a lamp is known from EP 88201 243 A1.

Lamps of the said type with, for example, sodium or a metal halide as the ionizable vapour have a relatively high optimal operating temperature. Thus the optimal lowest temperature of the discharge vessel is 260° C. if sodium vapour is the ionizable vapour. This means that the lamp requires a good thermal insulation of the discharge vessel. Thermal losses of the lamp may be reduced by restricting the flow of heat through the body of soft magnetic material.

Soft magnetic materials of low retentivity, however, have a low heat resistance. The specific magnetic losses increase with increasing temperature, while at an increased temperature, moreover, the magnetic permeability of said materials starts to decrease.

In proportion as the body of soft magnetic material is thermally better insulated from the discharge space, the heat insulation at the end of the body may have a higher thermal resistance without a critical temperature in said body being exceeded. A higher thermal resistance of the heat insulation leads to a better luminous efficacy of the lamp.

Materials which are suitable for use as a heat-repelling envelope, such as aerogels of $Al_2O_3$ or $SiO_2$, are expensive, as are synthetic materials having a very high thermal resistance. Such a heat-repelling envelope has a considerable influence on the cost price of the lamp.

SUMMARY OF THE INVENTION

The invention has for its object to provide a lamp of the kind described in the opening paragraph which has an inexpensive and effective heat-repelling envelope which is easy to manufacture.

According to the invention, this object is achieved in that a tube which is closed at one end, which surrounds the body of soft magnetic material with clearance and is enclosed with clearance in the cavity in the outer bulb, and which is open near the end portion of the discharge vessel, is used as a heat-repelling envelope.

It has been shown that such a tube with clearance provides a simple, inexpensive and effective insulation. The tube may be of, for example, glass or ceramic material, for example of white ceramic for a good light reflection, for example $Al_2O_3$. Such tubes can be manufactured in a simple manner.

Thanks to the presence of the tube and its clearance the soft magnetic body is surrounded by two gaps. It has been shown that there occurs no or substantially no convection in these gaps, if they are filled with air and are narrower than 5 mm. Since it is favourable to construct the lamp as compact as possible, gaps which are not wider than 1 mm will usually be chosen. The gap between the tube and the cavity in the outer bulb may be evacuated for an even better thermal insulation.

The use of a glass tube is very attractive because of its ready availability. Moreover, such a tube can be easily provided with bulges and dimples distributed over its surface, which separate the tube from the soft magnetic body and the cavity in the outer bulb, respectively.

A further increase in the heat insulation of the soft magnetic body may be achieved through the use of an infrared-reflecting coating between the discharge space and the low-retentivity magnetic body. This coating may consist of one or several interference layers of dielectric material, or of electrically conducting material, for example doped tin oxide or, for example, indium oxide doped with tin, or of a metal such as, for example, gold, silver, aluminium. If an electrically conducting material is used, it is advisable to provide the coating with interruptions which extend in the direction of the soft magnetic body. This serves to suppress eddy currents in the coating.

BRIEF DESCRIPTION OF THE DRAWING

An embodiment of the lamp according to the invention is shown in the drawing in lateral elevation, partly cut away.

DESCRIPTION OF THE PREFERRED EMBODIMENT

The electrodeless low-pressure discharge lamp of FIG. 1 has a discharge vessel 1 with a discharge space 2 containing an ionizable vapour, sodium, and rare gas, for example argon, and a cavity 4 at an end portion 3. An evacuated outer bulb 5 is arranged around the discharge vessel 1. The outer bulb 5 has a cavity 6 which enters the cavity 4. A body 7 of soft magnetic material is enclosed in the cavities 4, 6. The body 7 has an end 8 near the end portion 3 of the discharge vessel 1, which end is supported by a thermal insulator 9. An electric coil 10 is present around the body 7 of soft magnetic material, for example made of ferrite, such as 4C6 ferrite, inside the cavity 4 of the discharge vessel 1. The lamp has a heat-repelling envelope of electrically insulating material between the body 7 of soft magnetic material and the discharge space 2.

A tube 11, closed at one end, which surrounds the body 7 of soft magnetic material with clearance and which is enclosed with clearance by the cavity 6 in the outer bulb 5, and which is open near the end portion 3 of the discharge vessel 1, is used as a heat-repelling envelope of the body 7. The tube shown is made of glass and has dimples 12 and bulges 13 which keep said tube separated from the body 7 and the cavity 6 in the outer bulb, respectively, so that an insulating air gap, of approximately 1 mm in the drawing, is present inside and outside the tube.

The outer bulb is provided with an IR-reflecting coating 14 of, for example, indium oxide doped with tin. The discharge vessel 1 is mounted in the outer bulb 5 by means of a glass plate 15 which is provided with an IR-reflecting coating 16, an aluminium plate 17 and glass rings 18. Inside the outer bulb 5 is a holder 19 for an evaporable getter, such as, for example, barium.

The lamp is fixed in a shell 20 in which there is a supply unit 21, which has an output frequency of at least 1 MHz. Conductors 22 connected to said unit 21 extend to the coil 10. The shell carries a lamp cap 23 provided with contacts 24 which are connected to the unit 21. The thermal insulator 9 is supported by a mounting plate 25.

In a modification of the lamp shown, the space between the tube 11 and the cavity 4 in the discharge vessel 1 is evacuated.

The body of soft magnetic material of a lamp as shown in the drawing had a temperature of 290° C. during operation. In a similar lamp, in which the tube 11 was absent, and which was operated with the same load on the discharge vessel wall (0,118 w/cm$^2$), the temperature of the body was 320° C. The considerable temperature decrease caused by the measure according to the invention renders it possible to limit the thermal losses of the lamp caused by a heat flow in the direction of the lamp cap by giving the thermal insulator a higher heat resistance, for example, by making it longer and/or thinner.

I claim:

1. An electrodeless low-pressure discharge lamp having a discharge vessel with a discharge space containing an ionizable vapor and rare gas, the discharge vessel having an inwardly extending protuberance at an end portion thereof, which defines an exterior cavity in said discharge vessel, an outer bulb surrounding said discharge vessel and having an inwardly extending protuberance which defines an exterior cavity in said outer bulb, said bulb protuberance extending into said discharge vessel cavity for substantially its entire length, a body of soft magnetic material enclosed in said cavity of said outer bulb, which body has an end near said end portion of said discharge vessel, an electric coil disposed around said body of soft magnetic material, and a heat-insulating envelope of electrically insulating material between said magnetic body and said protuberance of said discharge vessel, the improvement comprising:

said heat insulating envelope being a tube disposed over said body of soft magnetic material and said electric coil, said tube being closed at one end and open at its other end near said end portion of said discharge vessel, and said tube being arranged with clearance between said body of magnetic material and said protuberance of said outer bulb.

2. An electrodeless discharge lamp as claimed in claim 1, characterized in that dimples and bulges distributed over the surface of the tube separate the tube from the cavity in the outer bulb and from the body of soft magnetic material.

3. An electrodeless discharge lamp as claimed in claim 1, characterized in that the gap between the tube and the cavity in the outer bulb is evacuated.

4. An electrodeless discharge lamp according to claim 1, wherein said clearances between said outer bulb protuberance and said tube and between said tube and said core are each less than 5 mm.

5. An electrodeless discharge lamp according to claim 1, wherein said clearances are each less than 1 mm.

6. An electrodeless low-pressure discharge lamp, comprising:

a discharge vessel sealed in a vacuum-tight manner and having a discharge space containing an ionizable vapor and rare gas, the discharge vessel having an inwardly extending protuberance defining an exterior cavity in said discharge vessel;

an outer bulb surrounding said discharge vessel and having an inwardly extending protuberance defining an exterior cavity in said outer bulb, said bulb protuberance projecting into the protuberance of said discharge vessel for substantially its entire length;

a body of soft magnetic material and an electric coil surrounding said body, both disposed within said protuberance of said outer bulb;

a housing connected to said discharge vessel and carrying a lamp cap with contacts;

a supply unit arranged in said housing and comprising a frequency converter having an output frequency of at least 1 MHz and being connected to the contacts at the lamp cap and to the electrical coil; and means for thermally insulating said core of magnetic material from said discharge vessel, said means comprising a tube of electrically insulating material disposed between said protuberance of said outer bulb and said coil with clearance therebetween, said tube being closed at one end and open at its opposite end near said end portion of said outer bulb.

7. An electrodeless discharge lamp according to claim 6, wherein said clearances between said outer bulb protuberance and said tube and between said tube and said core are each less than 5 mm.

8. An electrodeless discharge lamp according to claim 6, wherein said clearances are each less than 1 mm.

9. An electrodeless discharge lamp as claimed in claim 6, characterized in that said tube comprises dimples and bulges distributed over the surface of the tube for separating said tube from the protuberance of the outer bulb and from said body of soft magnetic material.

10. An electrodeless discharge lamp as claimed in claim 6, characterized in that the space between the tube and the protuberance of the outer bulb is evacuated.

* * * * *